US005945167A

United States Patent [19]

Kuwabara et al.

[11] Patent Number: 5,945,167

[45] **Date of Patent: *Aug. 31, 1999**

[54] METHOD OF MANUFACTURING COMPOSITE MATERIAL

[75] Inventors: Mitsuo Kuwabara; Mitsuhiro Funaki; Kazuhito Hiraga; Tetsuya Ohishi, all of Sayama, Japan

[73] Assignee: Honda Giken Kogyo Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/892,996

[22] Filed: Jul. 15, 1997

Related U.S. Application Data

[63] Continuation of application No. 08/549,188, Oct. 27, 1995, abandoned.

[30] Foreign Application Priority Data

Oct. 27, 1994 [JP] Japan ..... 6-264108
Nov. 8, 1994 [JP] Japan ..... 6-273931

[51] Int. Cl.[6] ..... B05D 3/02

[52] U.S. Cl. ..... 427/376.3; 427/379; 427/380; 427/314; 427/226

[58] Field of Search ..... 427/376.3, 379, 427/380, 314, 226

[56] References Cited

U.S. PATENT DOCUMENTS 3,757,878 9/1973 Wilder et al. ..... 175/329
3,816,081 6/1974 Hale ..... 29/182.7
4,746,363 5/1988 DeAngelis ..... 75/244
4,800,065 1/1989 Christodoulou et al. ..... 420/129
4,916,029 4/1990 Nagle et al. ..... 428/614
5,139,720 8/1992 Takeda et al. ..... 264/66
5,223,195 6/1993 Kuwabara ..... 264/60

FOREIGN PATENT DOCUMENTS 63-26346 2/1988 Japan ..... C23C 14/06

OTHER PUBLICATIONS

Periodic Table, No Date Available.

*Primary Examiner*—Shrive Beck
*Assistant Examiner*—Michael Barr
*Attorney, Agent, or Firm*—Birch, Stewart, Kolasch & Birch, LLP

[57] ABSTRACT

A grain growth accelerator in a form dispersed in an aqueous solution or an organic solvent is introduced into a preliminarily fired body, and thereafter the preliminarily fired body is fired in a main firing process. In the main firing process, a volumetric diffusion of metal and grain growth of ceramic particles are caused as the firing temperature increases. Therefore, it is possible to manufacture a composite material which has such a gradient function that it is ceramic-rich on its surface and metal-rich in its inside, a high degree of surface hardness and toughness, and an interface-free structure.

8 Claims, 10 Drawing Sheets

CUTTING RATE
(m/min.)
500
400
300
200
100
WORKPIECE: SCM435
64
65
69
61
COMMERCIALLY AVAILABLE PRODUCT TREATED BY CVD
COMMERCIALLY AVAILABLE PRODUCT TREATED BY PVD
5
10
20
30
40
50
SERVICE LIFE (min.)

CUTTING RATE
(m/min.)
500
400
300
200
100
65
64
69
63
WORKPIECE: FC25
5
10
20
30
40
50
SERVICE LIFE (min.)

METHOD OF MANUFACTURING COMPOSITE MATERIAL

This application is a continuation, of application Ser. No. 08/549,188 filed on Oct. 27, 1995, now abandoned.

BACKGROUND OF THE INVENTION

1. Field of the Invention

The present invention relates to a method of manufacturing a composite material of a ceramic powder and a metal powder, the composite material being ceramic-rich on its surface and metal-rich in its inside.

2. Description of the Related Art

Heretofore, ceramic materials have widely been used as mechanical components because of their high hardness and heat resistance. However, ceramic materials are disadvantageous because they are generally poor with respect to toughness. In view of the conventional ceramic materials, there have been proposed and used ceramic composite materials (hereinafter referred to as composite materials) made of ceramic and metal.

If the amount of ceramic in such a composite material is increased for increased wear resistance, then the hardness of the composite material increases, but the toughness thereof decreases, resulting in a reduction in the strength. A conventional solution to this problem includes a composite material (hereinafter referred to as a conventional composite material 1) in which mixed powders of metal and ceramic which have various different composition ratios are laminated stepwise. In addition, a conventional solution includes a composite material (hereinafter referred to as a conventional composite material 2) in which metal and ceramic are combined by cladding, fitting, or shrink fitting.

According to the conventional composite material 1, since the metal and ceramic are fired at largely different temperatures, the ceramic cannot be formed into a dense structure if it is fired at the temperature at which the metal is fired, and the composite material cannot hold its desired shape if the metal is fired at the temperature at which the ceramic is fired because it is higher than the melting point of the metal. Another problem is that the conventional composite material 1 tends to be deformed and cracked as the rate at which the metal and ceramic are densified and the composition-dependent shrinkage vary from temperature to temperature.

The conventional composite material 2 are also disadvantageous in that because there is an interface between the metal and ceramic, heat conduction and stress elastic waves concentrate on the interface, resulting in a thermal stress concentration and a stress concentration.

Carbide and cermet which have widely been used as materials for cutters including throw-away tips, drill bits, reamers, etc. wear rapidly when used to cut workpieces of iron and steel, and cause tip chipping depending the workpiece material cut thereby. It has been customary to coat such cutters of carbide and cermet with a hard ceramic layer by physical vapor deposition (PVD) or chemical vapor deposition (CVD) in order to produce a composite structure of ceramic and metal.

However, the coating process such as PVD or CVD is costly. Furthermore, when a layer coated by this coating process, such as a coated layer on a cutter, has a thickness of about 30 $\mu$m, the surface of the coated layer tends to peel off the surface of the base metal.

Japanese patent publication No. 4-24424 discloses the provision of a composite layer on the surface of a base metal, the composite layer comprising a coated layer produced by an arc-evaporated ion plating process and a coated layer produced by a fusion-evaporated ion plating process. However, the disclosed case-hardening technique suffers drawbacks in that it poses limitations on the use and size of objects that can be processed, necessarily results in an increase in the cost, requires a highly sophisticated level of technology for its implementation, and is carried out a complex operation.

SUMMARY OF THE INVENTION

It is a principal object of the present invention to provide a method of manufacturing a composite material whose properties vary across its depth for large surface hardness, high toughness, and interface-free structure.

The above and other objects, features, and advantages of the present invention will become more apparent from the following description when taken in conjunction with the accompanying drawings in which preferred embodiments of the present invention are shown by way of example.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
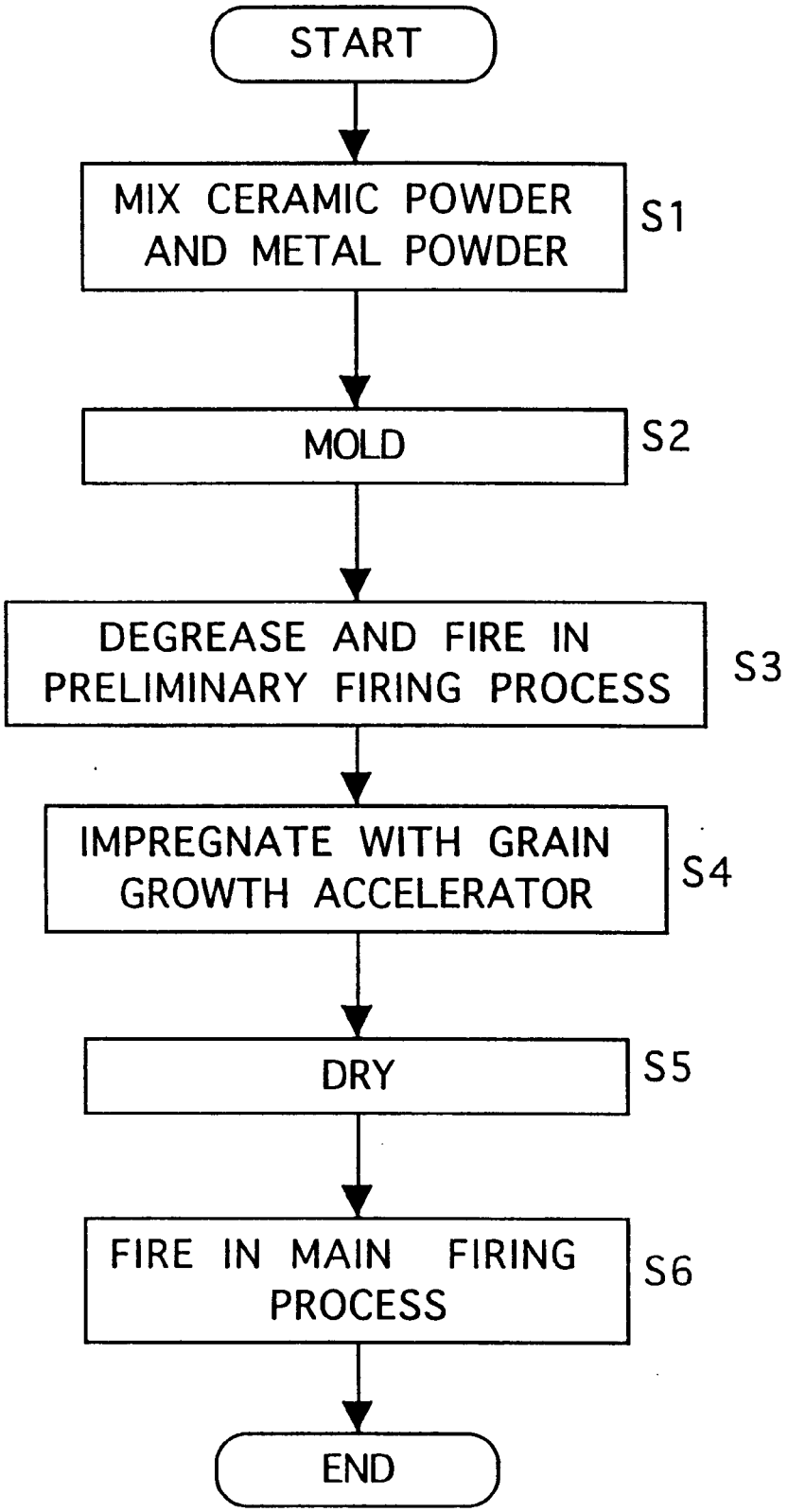
FIG. 1 is a flowchart of an operation sequence of a method of manufacturing a composite material according to a first embodiment of the present invention.

FIG. 1 shows an operation sequence of a method of manufacturing a composite material according to a first embodiment of the present invention. The method of manufacturing a composite material according to the first embodiment will be described below with reference to FIG. 1.

First, a mixture of material powders of metal and ceramic is prepared at a given composite ratio in a step S1, and then molded into a molded body in a step S2. The molded body is then degreased to remove a molding additive added when the molded body was produced, and then fired in a preliminary firing process at a temperature in the range of from 800° C. to 1000° C. for a period of time ranging from 15 minutes to 60 minutes in a step S3.

In the preliminary firing process, contacting regions of particles of the metal powder are joined by volumetric diffusion, producing necks. If such necks were formed excessively, contiguous pores or interstices would be closed, preventing a solution of metal salt or a solution of organic metal from being impregnated effectively in a subsequent step. When necks are formed, pores in the fired body need to be joined three-dimensionally. Therefore, the load imposed when the mixed powder is molded cannot be increased into a range for elastically deforming the metal, but should be in the range of from 100 MPa to 300 MPa.

After the molded body is fired in the preliminary firing process, a grain growth accelerator (ceramic particle growth accelerator) is introduced into the fired body in a step S4. Since it is most effective to introduce minimum units of the grain growth accelerator into the fired body, the grain growth accelerator is introduced in the form of ions or individual molecules. Specifically, the grain growth accelerator as it is dispersed in an aqueous solution or an organic solvent is introduced or impregnated into pores in the preliminarily fired body. While the grain growth accelerator may be introduced into the material powders when they are mixed, such an introduction is not preferable because a strict control process including a modification of the firing pattern will be needed because of influences on the greasing and firing step. When the grain growth accelerator is introduced into the preliminarily fired body, since necks of metal particles have been formed, a volumetric diffusion will be carried out smoothly in a firing step and will not affect the firing step.

After the solvent is dried off the preliminarily fired body in a step S5, the preliminarily fired body is fired in a main firing process in a step S6. In the main firing process, a volumetric diffusion of the metal and grain growth of the ceramic particles are caused as the firing temperature increases. The grain growth of the ceramic particles is an endothermic reaction, and begins to occur on the surface of the preliminarily fired body where the temperature rises most quickly. When an endothermic reaction takes place on the surface, a thermal gradient is produced because the surface is deprived of heat.

A small amount of the grain growth accelerator acts as a kind of catalyst and is introduced during the grain growth. Most of the grain growth accelerator moves further into the fired body, and is accumulated in a region where the grain growth is still small. Therefore, the degree of grain growth is determined by the heat, and the thickness and gradient of the region of grain growth can be controlled by the rate at which the temperature increases and the time in which the temperature is held.

The composite material thus formed is of such a composition that the ceramic component is about 100% in a surface region where the grain growth has progressed greatly, and the initial composite components prevail or a metal-rich structure is developed deeply inside the composite material. Therefore, the composite material has such a gradient function wherein it is ceramic-rich on its surface and metal-rich inside.

The fired body may be impregnated selectively with a grain growth accelerator or a material for forming a ceramic film. Alternatively, a molded body with its surface layer covered with a ceramic film may be fired to produce a grain growth region and a ceramic layer where the covered layer has a diffusion layer.

EXAMPLE 1

78 weight % of a powder of tungsten carbide (WC) having an average diameter of 2 μm, 2 weight % of a powder of tantalum carbide (TaC) having an average diameter of 1 μm, and 20 weight % of a powder of cobalt (Co) having an average diameter of 1 μm were sufficiently mixed with each other using a dispersing medium of methyl alcohol. The mixture was then granulated into particles having a diameter of about 100 μm, and molded into molded bodies each having a size of 22×5×80 mm under a molding pressure of 150 MPa. The molded bodies were then kept at 450° C. for 30 minutes in a vacuum, then 650° C. for 30 minutes in a vacuum, and thereafter 1050° C. for 60 minutes in a preliminary firing process, thereby producing preliminarily fired bodies.

The preliminarily fired bodies were then immersed respectively in aqueous solutions of 10%, 20%, and 30% of nickel nitrate and a saturated aqueous solution of nickel nitrate while being ultrasonically vibrated, so that the preliminarily fired bodies were impregnated with the solutions of nickel nitrate. The preliminarily fired bodies were ultrasonically vibrated at a frequency of 16 MHz, and immersed in the solutions of nickel nitrate for 10 minutes.

Thereafter, the preliminarily fired bodies were fired in a main firing process. Specifically, they were dried at 80° C. for 12 hours. Then, the temperature increased to 1000° C. at a rate of 10° C./minute, and the preliminarily fired bodies were kept at 1000° C. for 30 minutes. Thereafter, the temperature increased to 1360° C. at a rate of 5° C./minute, and the preliminarily fired bodies were kept at 1360° C. for 90 minutes. As result, the preliminarily fired bodies were formed into composite materials.

Figure 2:
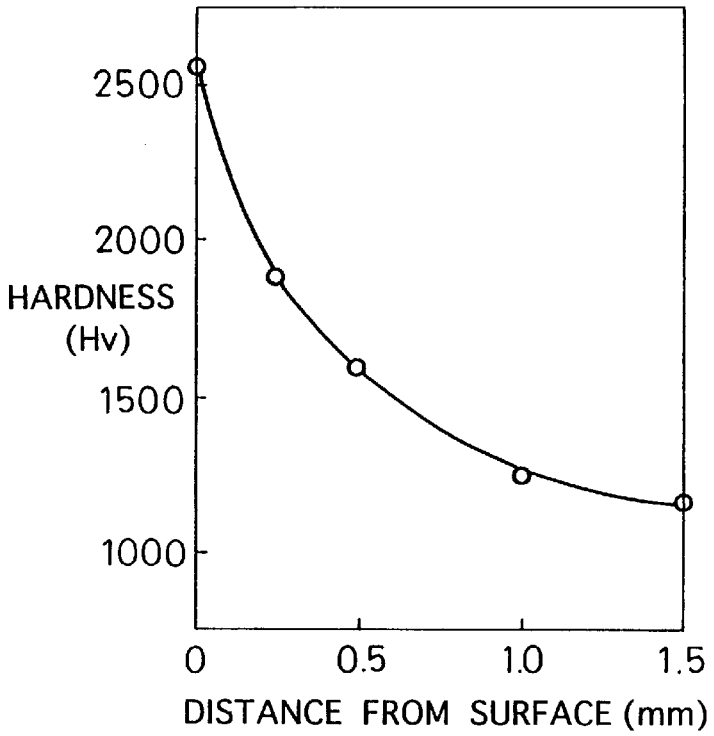
FIG. 2 is a diagram showing the relationship between the distance from the surface and the hardness of a composite material.
Figure 3:
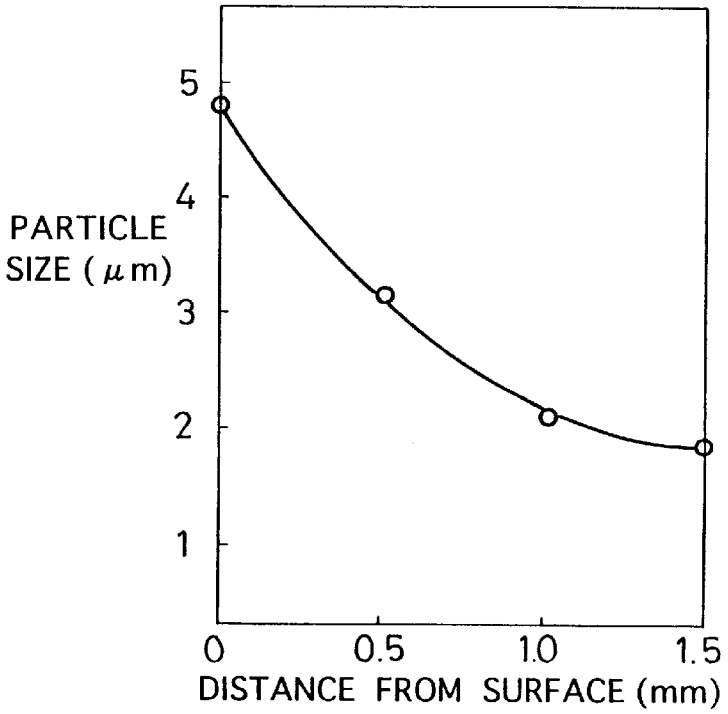
FIG. 3 is a diagram showing the relationship between the distance from the surface and the diameter of particles of the composite material.
Figure 4:
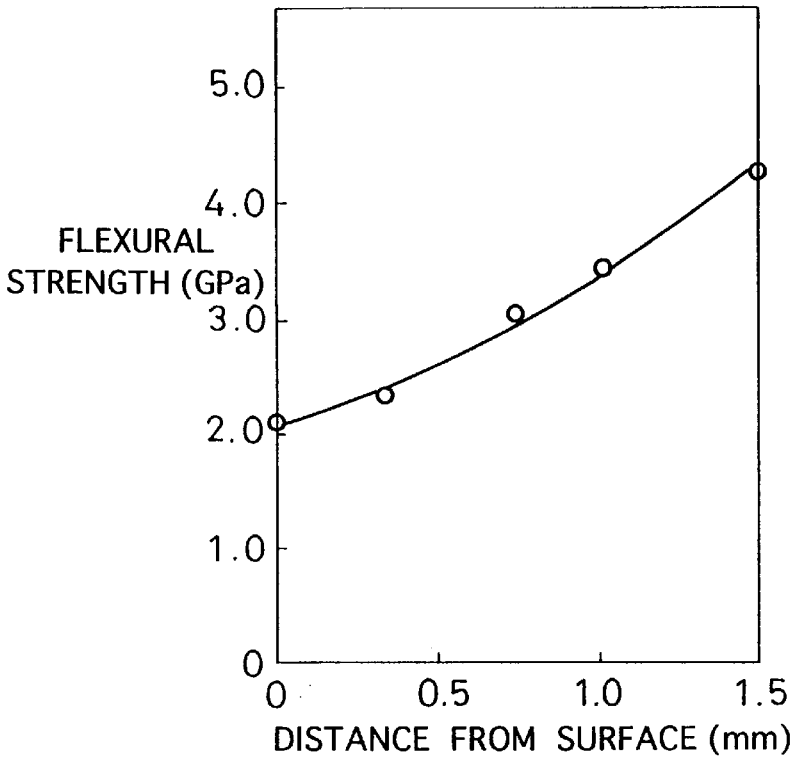
FIG. 4 is a diagram showing the relationship between the distance from the surface and the flexural strength of the composite material.
Figure 5:
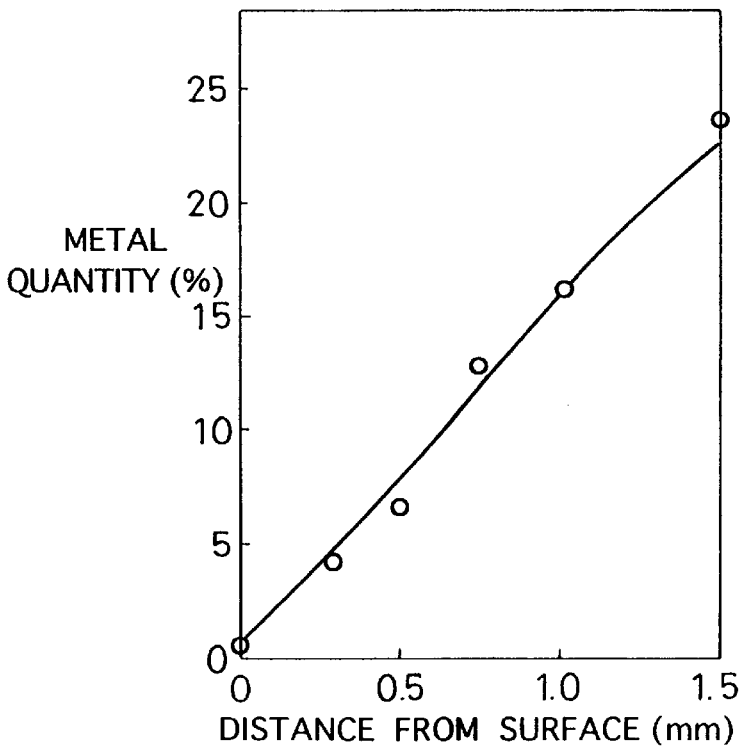
FIG. 5 is a diagram showing the relationship between the distance from the surface and the quantity of metal of the composite material.
Figure 6:
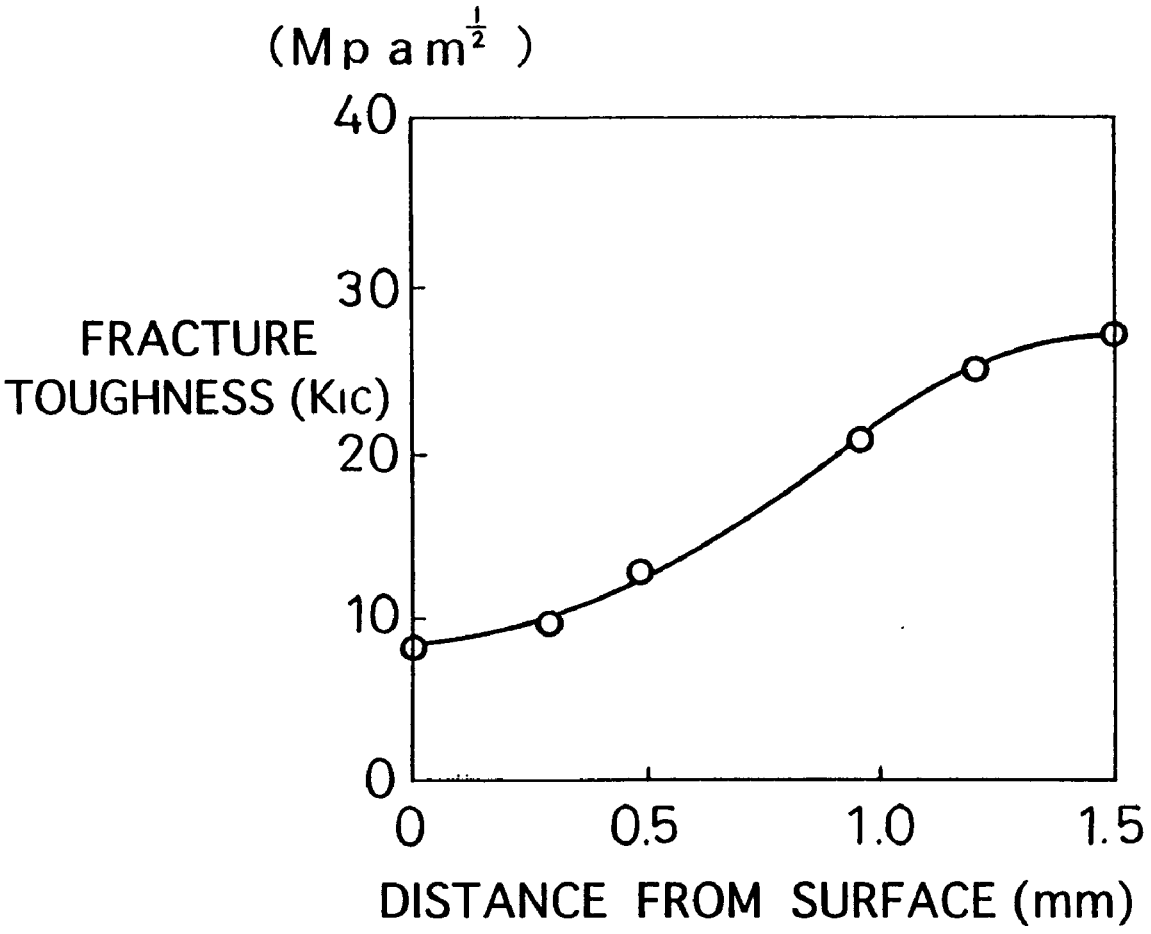
FIG. 6 is a diagram showing the relationship between the distance from the surface and the fracture toughness of the composite material.

The surface of each of the composite materials was ground to a mirror finish. Each of the composite materials was cut at its center, and cut sections were ground to a mirror finish and inspected for Hv hardness and changes in the average diameter by an electron microscope. The measured hardness and changes in the average diameter are shown in FIGS. 2 and 3. The composite materials were cut into many test pieces each having a thickness of 1 mm, and the test pieces were inspected for flexural strength with a span of 30 mm. Changes in the flexural strength depending on the distance from the surface of each of the test pieces were shown in FIG. 4. FIG. 5 shows changes in the quantity of metal depending on the distance from the surface of each of the test pieces as a result of a chemical analysis of each of the test pieces removed from the flexural strength test. FIG. 6 shows changes in the fracture toughness depending on the distance from the surface of each of the test pieces.

According to Example 1, it was found out that the properties including the hardness, strength, etc. of the compound material varied in a gradient pattern across the depth thereof due to the grain growth. It was seen from FIG. 5 that the quantity of metal varied in a gradient pattern into the compound material as ceramic particles grew. Among the measured properties, the surface hardness was of a high value of 2500 Hv, comparable to those of coated layers produced by PVD or CVD, and the strength was of 4.5 GPa comparable to that of an ultra-fine high-grade carbide product. The fracture toughness had values corresponding to those of FC materials. The properties including the hardness, the strength, and the toughness had values which had not been achieved by the conventional materials, due to the grain growth of ceramic particles.

EXAMPLE 2

Metal and ceramic powders for making composite materials were prepared according to the compositions shown in Table 1 given below, and sufficiently mixed with each other. The mixtures were then molded into test pieces each having a size of 22×5×80 mm. The test pieces were then fired at a temperature ranging from 900° C. to 1000° C. in a preliminary firing process. The preliminarily fired bodies were impregnated with various metal salts and organic metals, used as grain growth accelerators, shown in Experimental Examples 1 through 24 in Table 1. After the preliminarily fired bodies were dried at a temperature ranging from 1360° C. to 1450° C., they were fired in a main firing process under a pressure of 1 bar or a reduced pressure in the range of from 0.1 to 1 Torr in a nitrogen atmosphere.

TABLE 1

Composite material compositions, grain growth accelerators, and firing temperatures

| Exp.Ex. | Composite material composition | Grain growth accelerator and concentration | | Firing temp. (° C.) |
|---|---|---|---|---|
| 1 | 75WC2NbC1TaC- | nickel nitrate | 25% | 1360 |
| 2 | 10TiC5TiNlTaN- | nickel acetate | 20% | 1360 |
| 3 | 6Co | nickel chloride | 20% | 1360 |
| 4 | | chromium nitrate | 20% | 1380 |
| 5 | | manganese acetate | 15% | 1360 |
| 6 | | manganese nitrate | 20% | 1360 |
| 7 | 30TiCl5TiN- | chromium nitrate | 25% | 1380 |
| 8 | $20Al_2O_3$29Co1Fe | ammonium molybdate | 20% | 1380 |
| 9 | $45CrB_2$15$Mo_2B_5$- | iron nitrate | 30% | 1400 |
| 10 | 36Ni2Ti2Al | cobalt acetate | 15% | 1400 |
| 11 | $30Mo_2B_5$20$ZrB_2$- | manganese nitrate | 20% | 1380 |
| 12 | 5TiCl5$CrB_2$- | cobalt isopropoxide | 100% | 1380 |
| 13 | 5$Cr_3C_2$5HfN26Ni- | chromium triethylamide | 30% | 1380 |
| 14 | 2AllTi | chromium imide | 20% | 1380 |
| 15 | | chromium nitrate | 20% | 1380 |
| 16 | $30Al_2O_3$3$TiO_2$- | cobalt isopropoxide | 100% | 1420 |
| 17 | 20TiCN2$Cr_2O_3$- | chromium ethoxide | 50% | 1420 |
| 18 | 5$ZrO_2$10$Mo_2B_5$- | ferric chloride | 10% | 1380 |
| 19 | 5$V_2O_3$5Mo2OCr | iron nitrate | 25% | 1380 |
| 20 | | nickel nitrate | 20% | 1380 |
| 21 | 68$Si_3N_4$3$Al_2O_3$- | cobalt nitrate | 20% | 1450 |
| 22 | 2AlN5$Y_2O_3$2TiCN- | iron nitrate | 20% | 1430 |
| 23 | 20Ni | manganese acetate | 10% | 1430 |
| 24 | | cobalt nitrate 20% + manganese acetate 2% | | 1430 |

Comparative examples A~F were prepared by firing the composite compositions in a main firing process without impregnating them with any grain growth accelerators. The fired bodies were ground to a mirror finish, and measured for Hv hardness at positions spaced a given distance inwardly from their surfaces. Bending test pieces each having a thickness of 1 mm and a size of 4×50 mm were cut from the fired bodies, and measured for a bending strength at a span of 30 mm. The results of the measured hardness and bending strength are shown in Table 2 given below.

TABLE 2

| | Hardness Hv | | | | | | | Bending Strength GPa | | |
|---|---|---|---|---|---|---|---|---|---|---|
| No. | Surface | 0.2 mm | 0.3 mm | 0.5 mm | 0.7 mm | 1.0 mm | 2.0 mm | Surface ~1mm | 0.5~1.5 mm | 1.0~2.0 mm |
| 1 | 2480 | 2310 | 2200 | 2010 | 1830 | 1530 | 1410 | 2.2 | 2.5 | 2.8 |
| 2 | 2200 | 2060 | 1980 | 1820 | 1690 | 1540 | 1430 | 1.8 | 2.1 | 2.5 |
| 3 | 2310 | 2150 | 2000 | 1840 | 1710 | 1580 | 1460 | 2.2 | 2.3 | 2.4 |
| 4 | 2500 | 2410 | 2350 | 2100 | 1970 | 1540 | 1430 | 2.4 | 2.6 | 2.9 |
| 5 | 2100 | 2050 | 1960 | 1740 | 1610 | 1500 | 1300 | 1.9 | 2.2 | 2.3 |
| 6 | 2180 | 2070 | 1980 | 1780 | 1650 | 1480 | 1280 | 2.0 | 2.3 | 2.6 |
| A | 1580 | 1600 | 1540 | 1600 | 1580 | 1570 | 1590 | 2.1 | 2.0 | 2.1 |

TABLE 2-continued

| No. | Hardness Hv Surface | 0.2 mm | 0.3 mm | 0.5 mm | 0.7 mm | 1.0 mm | 2.0 mm | Bending Strength GPa Surface ~1mm | 0.5~ 1.5 mm | 1.0~ 2.0 mm |
|---|---|---|---|---|---|---|---|---|---|---|
| 7 | 2300 | 2100 | 2040 | 1850 | 1640 | 1430 | 1240 | 1.8 | 2.2 | 2.6 |
| 8 | 2100 | 1980 | 1840 | 1760 | 1520 | 1400 | 1180 | 1.6 | 1.9 | 2.2 |
| B | 1120 | 1130 | 1120 | 1110 | 1130 | 1100 | 1120 | 1.3 | 1.5 | 1.4 |
| 9 | 1620 | 1550 | 1460 | 1380 | 1190 | 1050 | 920 | 1.5 | 1.7 | 2.2 |
| 10 | 1670 | 1590 | 1490 | 1400 | 1220 | 1130 | 940 | 1.3 | 1.6 | 2.0 |
| C | - | - | - | - | - | - | - | - | - | - |
| 11 | 1940 | 1820 | 1710 | 1590 | 1430 | 1300 | 1130 | 1.8 | 2.1 | 2.3 |
| 12 | 1890 | 1800 | 1680 | 1580 | 1410 | 1310 | 1090 | 2.0 | 2.3 | 2.5 |
| 13 | 2410 | 2280 | 2110 | 1810 | 1610 | 1400 | 1120 | 2.2 | 2.4 | 2.7 |
| 14 | 2300 | 2150 | 2020 | 1740 | 1540 | 1360 | 1100 | 2.1 | 2.4 | 2.6 |
| 15 | 2100 | 2030 | 1890 | 1700 | 1500 | 1320 | 1120 | 2.4 | 2.8 | 2.9 |
| D | 1100 | 1080 | 1080 | 1100 | 1090 | 1080 | 1090 | 2.0 | 2.1 | 2.1 |
| 16 | 2100 | 1920 | 1850 | 1710 | 1520 | 1310 | 1170 | 1.4 | 1.7 | 1.9 |
| 17 | 2180 | 1940 | 1860 | 1670 | 1410 | 1200 | 1180 | 1.2 | 1.4 | 1.6 |
| 18 | 1760 | 1680 | 1540 | 1470 | 1290 | 1150 | 1120 | 1.1 | 1.3 | 1.4 |
| 19 | 1890 | 1710 | 1650 | 1480 | 1260 | 1180 | 1100 | 1.3 | 1.5 | 1.7 |
| 20 | 2200 | 2000 | 1840 | 1710 | 1450 | 1280 | 1160 | 1.6 | 1.8 | 2.1 |
| E | 1150 | 1130 | 1150 | 1140 | 1150 | 1130 | 1140 | 1.0 | 0.9 | 1.0 |
| 21 | 1850 | 1800 | 1740 | 1630 | 1560 | 1400 | 1280 | 1.5 | 1.9 | 2.2 |
| 22 | 1780 | 1720 | 1680 | 1610 | 1520 | 1380 | 1340 | 1.4 | 1.7 | 1.9 |
| 23 | 1920 | 1850 | 1760 | 1650 | 1570 | 1450 | 1180 | 1.6 | 1.9 | 2.2 |
| 24 | 1960 | 1860 | 1800 | 1710 | 1620 | 1480 | 1310 | 1.8 | 2.2 | 2.5 |
| F | 1600 | 1580 | 1590 | 1570 | 1570 | 1580 | 1590 | 1.4 | 1.4 | 1.3 |

A ~ F: Comparative examples

Changes in the size of constituent particles of the composite materials were measured at central sections of the test pieces from their surfaces by an electron microscope, and changes in the metal quantity depending on the distance from the surfaces were detected. The measured changes are shown in Tables 3, 4 given below.

TABLE 3

| No. | Average particle sizes (μm) Surface | 0.1 mm | 0.2 mm | 0.3 mm | 0.5 mm | 0.7 mm | 1.0 mm | 1.5 mm | 2.0 mm |
|---|---|---|---|---|---|---|---|---|---|
| 1 | 4.8 | 4.4 | 3.9 | 3.6 | 3.2 | 2.8 | 2.5 | 2.3 | 2.1 |
| 2 | 3.9 | 3.7 | 3.6 | 3.3 | 3.0 | 2.6 | 2.3 | 2.1 | 2.2 |
| 3 | 4.3 | 3.9 | 3.6 | 3.2 | 2.9 | 2.5 | 2.4 | 2.3 | 2.2 |
| 4 | 4.6 | 4.3 | 4.0 | 3.7 | 3.4 | 2.9 | 2.7 | 2.5 | 2.3 |
| 5 | 3.8 | 3.5 | 3.3 | 3.0 | 2.7 | 2.5 | 2.3 | 2.2 | 2.3 |
| 6 | 4.1 | 3.7 | 3.4 | 3.1 | 2.8 | 2.5 | 2.4 | 2.2 | 2.2 |
| A | 2.3 | 2.3 | 2.4 | 2.1 | 2.0 | 2.1 | 2.2 | 2.1 | 2.2 |
| 7 | 3.8 | 3.4 | 3.2 | 3.1 | 3.0 | 2.4 | 2.2 | 1.9 | 1.6 |
| 8 | 3.5 | 3.3 | 3.1 | 2.8 | 2.5 | 2.2 | 2.0 | 1.7 | 1.7 |
| B | 1.8 | 1.7 | 1.7 | 1.6 | 1.7 | 1.7 | 1.6 | 1.6 | 1.6 |
| 9 | 3.6 | 3.4 | 3.1 | 2.9 | 2.6 | 2.5 | 2.3 | 2.3 | 2.3 |
| 10 | 3.9 | 3.7 | 3.4 | 3.1 | 2.8 | 2.7 | 2.4 | 2.4 | 2.3 |
| C | 2.3 | 2.3 | 2.4 | 2.3 | 2.2 | 2.3 | 2.3 | 2.4 | 2.3 |
| 11 | 2.8 | 2.6 | 2.5 | 2.4 | 2.4 | 2.1 | 1.9 | 1.8 | 1.8 |
| 12 | 3.1 | 3.0 | 2.8 | 2.6 | 2.5 | 2.3 | 2.0 | 1.8 | 1.8 |
| 13 | 3.5 | 3.3 | 3.1 | 2.8 | 2.6 | 2.4 | 2.1 | 1.9 | 1.8 |
| 14 | 3.7 | 3.5 | 3.2 | 3.6 | 2.8 | 2.6 | 2.3 | 2.0 | 1.8 |
| 15 | 4.1 | 3.7 | 3.5 | 3.2 | 2.7 | 2.6 | 2.4 | 2.1 | 1.8 |
| D | 1.9 | 1.8 | 1.9 | 1.8 | 1.8 | 1.8 | 1.8 | 1.8 | 1.8 |
| 16 | 2.4 | 2.3 | 2.2 | 2.0 | 1.9 | 1.7 | 1.6 | 1.5 | 1.5 |
| 17 | 3.6 | 3.4 | 3.1 | 2.8 | 2.5 | 2.2 | 2.0 | 1.8 | 1.5 |
| 18 | 2.5 | 2.4 | 2.3 | 2.1 | 2.0 | 1.8 | 1.6 | 1.5 | 1.5 |
| 19 | 2.8 | 2.7 | 2.6 | 2.4 | 2.2 | 1.9 | 1.7 | 1.5 | 1.5 |
| 20 | 3.8 | 3.6 | 3.4 | 3.1 | 2.7 | 2.4 | 2.0 | 1.7 | 1.5 |
| E | 1.6 | 1.5 | 1.4 | 1.5 | 1.5 | 1.4 | 1.5 | 1.5 | 1.5 |

A ~ E: comparative examples

TABLE 4

| No. | Metal component (%) Surface | 0.1 mm | 0.3 mm | 0.7 mm | 1.0 mm | 2.0 mm |
|---|---|---|---|---|---|---|
| 1 | 3.9 | 4.5 | 5.2 | 5.6 | 6.2 | 6.7 |
| 2 | 4.8 | 5.1 | 5.9 | 6.4 | 6.3 | 6.2 |
| 3 | 4.3 | 4.8 | 5.1 | 5.9 | 6.5 | 6.3 |
| 4 | 4.1 | 4.7 | 5.3 | 6.1 | 6.7 | 6.3 |
| 5 | 5.0 | 5.3 | 5.7 | 6.2 | 6.5 | 6.2 |
| 6 | 4.7 | 5.0 | 5.4 | 6.1 | 6.5 | 6.3 |
| A | 6.2 | 6.1 | 5.9 | 6.0 | 5.9 | 6.1 |
| 7 | 26.3 | 27.5 | 28.9 | 29.4 | 29.7 | 32.1 |
| 8 | 27.4 | 28.4 | 29.1 | 29.7 | 30.1 | 31.7 |
| B | 30.2 | 30.4 | 30.2 | 29.8 | 29.9 | 30.1 |
| 9 | 36.4 | 37.8 | 38.7 | 39.6 | 39.8 | 41.5 |
| 10 | 35.5 | 36.4 | 37.3 | 38.5 | 39.4 | 42.3 |
| C | 39.8 | 39.7 | 40.2 | 40.1 | 40.0 | 40.1 |
| 11 | 27.4 | 28.2 | 28.9 | 29.2 | 29.7 | 31.7 |
| 12 | 27.6 | 28.2 | 28.6 | 28.9 | 29.6 | 32.4 |
| 13 | 25.4 | 26.8 | 27.6 | 28.2 | 28.9 | 32.3 |
| 14 | 25.1 | 25.9 | 26.9 | 27.7 | 28.4 | 33.8 |
| 15 | 24.8 | 25.4 | 25.7 | 26.8 | 27.5 | 34.1 |
| D | 29.6 | 29.8 | 30.0 | 29.9 | 30.1 | 30.1 |
| 16 | 23.6 | 23.9 | 24.2 | 24.6 | 24.9 | 26.2 |
| 17 | 21.4 | 23.2 | 23.6 | 24.1 | 24.4 | 27.6 |
| 18 | 23.8 | 23.8 | 24.0 | 24.5 | 24.9 | 25.8 |
| 19 | 23.6 | 23.8 | 24.0 | 24.6 | 25.1 | 25.7 |
| 20 | 21.1 | 21.9 | 22.7 | 23.6 | 24.8 | 27.8 |
| E | 24.3 | 24.8 | 25.1 | 25.0 | 24.7 | 24.9 |

A ~ E: Comparative examples

It will be understood from the above data that the properties vary inwardly from the surface of each of the composite materials according to Example 2. Such property variations are caused by the grain growth. The chemical composition varied upon the grain growth (see Table 3). It was confirmed that as ceramic particles of a constituent component of the composite materials grew, the metal in the surface move inwardly, and the chemical composition varied in a gradient fashion.

Figure 7:
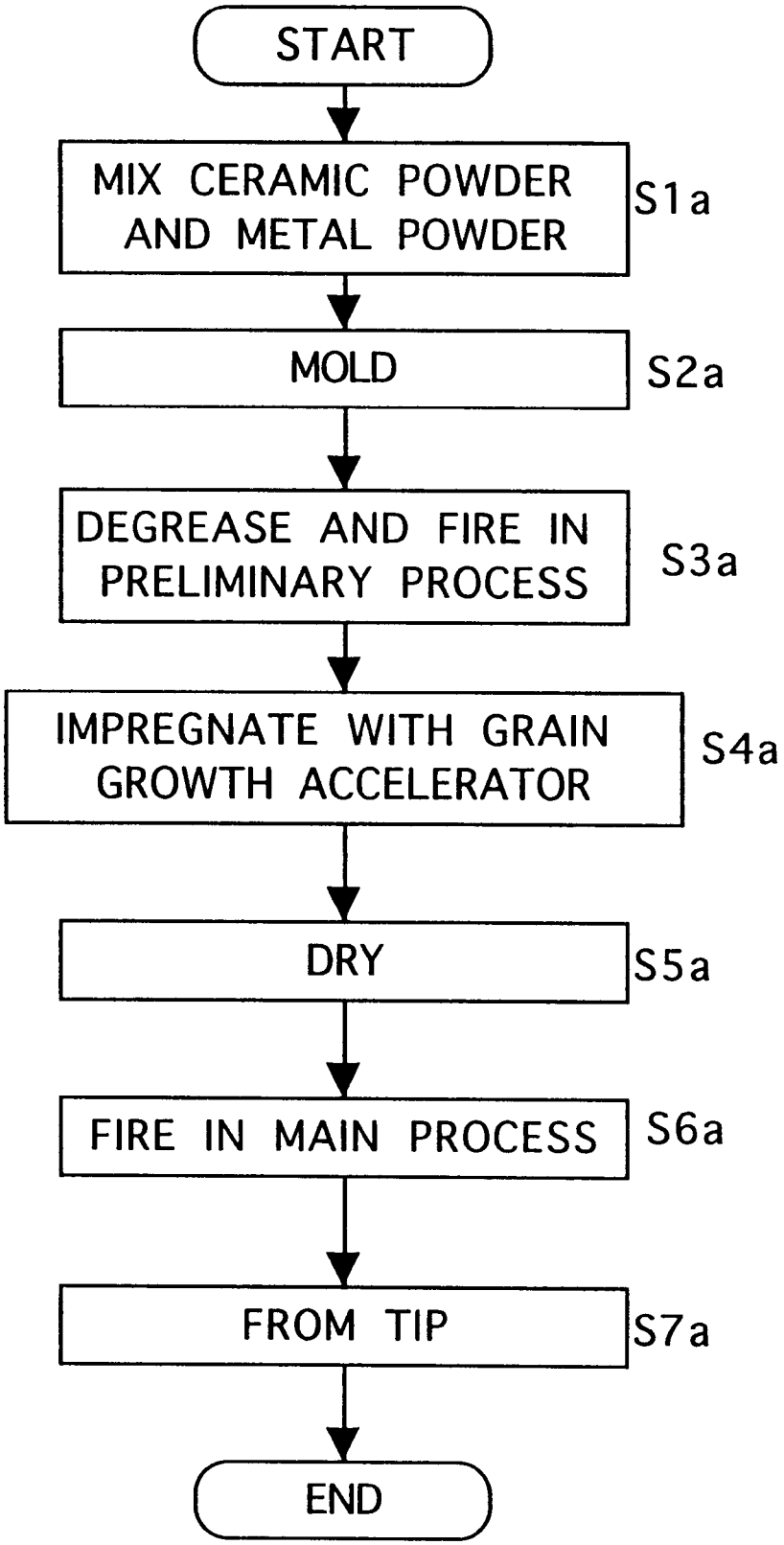
FIG. 7 is a flowchart of an operation sequence of a method of manufacturing a composite material according to a second embodiment of the present invention.

FIG. 7 shows an operation sequence of a method of manufacturing a composite material according to a second embodiment of the present invention. The method of manufacturing a composite material according to the second embodiment will be described below with reference to FIG. 1.

Hard particles of carbide, cermet, or the like are mainly composed of tungsten carbide (WC) and titanium carbide (TiC). A grain growth accelerator (ceramic particle growth accelerator) for the hard particles is selected which can easily react with at least W or C. of the tungsten carbide and whose composition varies gradually even if the other component is present in a group of molecules thereof. Materials which satisfy such requirements are elements belonging to the VIII, VII B, VI B, VB and IV B of groups of the periodic table. Their effect decreases as the group number is lowered, and increases as the period increases.

In view of the above considerations, nickel (Ni), iron (Fe), manganese (Mn), and chromium (Cr) are preferable for use as a grain growth accelerator for WC particles, and cobalt (Co), iron (Fe), and chromium (Cr) are preferable for use as a grain growth accelerator for TiC particles. W in the WC particles and Ti in the TiC particles are applicable in the case where hydrogen is used as a firing atmosphere.

A mixture of material powders of metal and ceramic is prepared at a given composite ratio in a step S1*a,* and then molded into a molded body in a step S2*a*. The molded body is then degreased to remove a molding additive added when the molded body was produced, and then fired in a preliminary firing process in a step S3*a*.

In the preliminary firing process, contacting regions of particles of the metal powder are joined by volumetric diffusion, producing necks. When such necks are formed, pores are joined. Then, a grain growth accelerator is introduced into the pores in a step S4*a*. Since it is most effective to introduce minimum units of the grain growth accelerator into the fired body, the grain growth accelerator is introduced in the form of ions or individual molecules. Specifically, the grain growth accelerator as it is dispersed in an aqueous solution of a nitrate, a chloride, or an acetate or an organic solvent is introduced or impregnated into pores in the preliminarily fired body. The concentration of the grain growth accelerator is greatest in the vicinity of the surface of the preliminarily fired body due to a reaction trap, a molecular sieve effect, and a temperature gradient at the time the preliminarily fired body is dried, and gradually decreases inwardly. As a result, the composition concentration varies in a gradient manner.

When the grain growth accelerator is impregnated or in a next step, an element which is converted into ceramic to form a hard layer on the surface of carbide or cermet is impregnated in the preliminarily fired body. The element should preferably be titanium (Ti), chromium (Cr), aluminum (Al), vanadium (V), or zirconium (Zr). The element may be impregnated as a compound in the form of an inorganic salt, but should preferably be impregnated as a compound in the form of an organic metal salt whose molecules are larger than those of the grain growth accelerator and which are more liable to stay on the surface. If an alkoxide, imide, amide, or the like such as ethoxide, propoxide, or butoxide is used, its organic decomposed residual reacts with the metal, forming a carbide. Nitriding or carburizing can be effected if the firing atmosphere is of nitrogen or carbon monoxide. It is possible to control the degree of an oxide by decomposition, oxidization, or the like.

After the solvent is dried off in a step S5*a,* the preliminarily molded body is fired in a main firing process in a step S6*a*. In the main firing process, the impregnated grain growth accelerator is decomposed from its salt form into an oxide or metal. Although the oxide or metal is reduced by a temperature increase or a partial pressure of the atmosphere, a portion of the oxide or metal is trapped into the hard particles, reducing the potential energy of the hard particles. Therefore, the hard particles disposed adjacent to each other are mutually diffused into each other through the medium of the grain growth accelerator, resulting in particle growth.

Within the carbide or cermet, the size of the particles and the metal quantity vary in a gradient fashion due to the concentration of the grain growth accelerator and the rate at which the temperature increases in the vicinity of the densifying temperature. Titanium isopropoxide, for example, disposed so as to be converted into a ceramic layer in the vicinity of the surface, is decomposed into an oxide or carbide as the firing temperature increases, but is unstable at temperatures below 1000° C. At higher temperatures, preferably 1300° C. or higher, it generates a carbonitride if the atmosphere is of nitrogen or a carbide if the atmosphere is of carbon monoxide under a catalytic action of nickel, bonding cobalt, or the like added as the grain growth accelerator. The grain growth accelerator which performed a catalytic action for accelerating the grain growth of TiC, TiN, or the like is discharged into grain boundaries, and acts as a stiffening material to contribute to an increase in the strength and toughness.

The fired body is thereafter machined or processed into a final product such as a tip, a drill bit, a reamer, or the like in a step S7*a*.

EXAMPLE 3

51 weight % of a powder of tungsten carbide (WC) having an average diameter of 2 μm, 35 weight % of a powder of titanium carbide (TiC) having an average diameter of 1.5 μm, 5 weight % of a powder of titanium nitride (TiN) having an average diameter of 1.2 μm, 3 weight % of a powder of tantalum carbide (TaC) having an average diameter of 1.0 μm, and 6 weight % of cobalt (Co) having an average diameter of 0.8 μm were prepared and sufficiently mixed with each other in a wet process using an organic medium. After being mixed, the liquid in the mixture was adjusted to 3 weight %. The mixture was then molded into molded bodies each having a size of 15.9×15.9×120 mm by an isostatic pressing process using a mold.

After being dried, the molded bodies were kept at 450° C. for 30 minutes, then 650° C. for 30 minutes, and thereafter 1000° C. for 30 minutes in a preliminary firing process, thereby producing preliminarily fired bodies. The preliminary firing process was carried out in a vacuum, and the temperature increased at a rate of 10° C./minute. The preliminarily fired bodies shrank by about 0.8%, and had a three-point bending strength of about 2 MPa, with necks formed therein.

The preliminarily fired bodies were then immersed in metal salt solutions A~F shown in Table 5, and after being dried, immersed selectively in organic metal salt solutions g~o shown in Table 6. Combinations of those immersing solutions are shown in Experimental Examples 32~54 in Table 7 given below.

Each of the preliminarily fired bodies selectively immersed in the organic metal salt solutions g~o was dried in a drier at 80° C. for 12 hours, and then fired. Specifically in the firing process, each of the preliminarily fired bodies was kept at 450° C. for 15 minutes and 650° C. for 30 minutes, then at 1240° C. for 10 minutes, and at 1320° C. for 15 minutes. In the firing process thus far, the temperature increased at a rate of 10° C./minute, and each of the preliminarily fired bodies was fired in a vacuum environment.

Thereafter, the temperature increased at a rate of 10° C./minute up to 1360° C., and each of the preliminarily fired bodies was kept at 1360° C. for 30 minutes. Then, the temperature increased at a rate of 5° C./minute up to 1380° C., and each of the preliminarily fired bodies was kept at 1380° C. for 90 minutes. Below 1320° C., each of the preliminarily fired bodies was kept in a nitrogen atmosphere under a pressure ranging from 3 to 5 Torr. At temperatures higher than 1320° C., each of the carbide tips was kept in a nitrogen atmosphere under a pressure of 1 bar. After being held at 1380° C., each of the preliminarily fired bodies was quenched to 1000° C., kept at 1000° C. for 60 minutes, and thereafter quenched to room temperature. While each of the preliminarily fired bodies was being quenched, it was held in a nitrogen gas under a pressure of 3.5 bar. All the fired bodies thus produced exhibited a shrinkage of about 20%, and a relative density of about 100%.

TABLE 5

| | Type of metal salt | Concentration of metal salt |
|---|---|---|
| A | nickel nitrate | 25% |
| B | nickel acetate | 20% |
| C | chromium nitrate | 15% |
| D | manganese acetate | 15% |
| E | iron (II) chloride | 20% |
| F | tungsten nitrate | 10% |

TABLE 6

| | Type of organic metal salt | Concentration of organic metal salt |
|---|---|---|
| g | aluminum isopropoxide | 60% |
| h | titanium isopropoxide | 40% |
| i | zirconium isopropoxide | 50% |
| j | titanium ethoxide | 30% |
| k | zirconium butoxide | 60% |
| l | aluminum imide | 50% |
| m | chromium imide | 80% |
| n | vanadium isopropoxide | 60% |
| o | chromium amide | 40% |

TABLE 7

| Exp. Ex. | Combinations of immersing sol. | Measured hardness (Hv) Distance from surface 0.1 mm | 0.2 mm | 0.3 mm | 0.5 mm | 0.7 mm | 1.0 mm | 3.0 mm | 6.0 mm |
|---|---|---|---|---|---|---|---|---|---|
| 31 | Comparative Example | 1620 | 1620 | 1630 | 1620 | 1640 | 1620 | 1620 | 1630 |
| 32 | A | 2150 | 2000 | 1890 | 1780 | 1720 | 1650 | 1580 | 1560 |
| 33 | C | 2240 | 2110 | 2030 | 1860 | 1780 | 1690 | 1650 | 1630 |
| 34 | D | 1890 | 1780 | 1710 | 1670 | 1620 | 1570 | 1630 | 1620 |
| 35 | E | 1780 | 1720 | 1690 | 1650 | 1550 | 1520 | 1610 | 1610 |
| 36 | A → g + h | 2480 | 2210 | 1980 | 1830 | 1760 | 1680 | 1590 | 1570 |
| 37 | C → g + h | 2510 | 2290 | 2080 | 1920 | 1780 | 1680 | 1630 | 1630 |
| 38 | D → g + h | 2280 | 1840 | 1730 | 1660 | 1620 | 1600 | 1590 | 1610 |
| 39 | E → g + h | 2140 | 1800 | 1730 | 1680 | 1520 | 1540 | 1580 | 1560 |
| 40 | A → i | 2380 | 2180 | 1920 | 1800 | 1710 | 1640 | 1630 | 1640 |
| 41 | A → g + i | 2340 | 2190 | 1940 | 1850 | 1780 | 1700 | 1650 | 1650 |
| 42 | C → i | 2420 | 2250 | 2060 | 1880 | 1760 | 1700 | 1680 | 1670 |
| 43 | A → l + m | 2410 | 2180 | 1960 | 1850 | 1780 | 1690 | 1640 | 1650 |
| 44 | A → n | 2150 | 2010 | 1880 | 1740 | 1680 | 1640 | 1620 | 1640 |
| 45 | A → m | 2340 | 2120 | 1890 | 1760 | 1680 | 1680 | 1680 | 1680 |
| 46 | F | 2150 | 2000 | 1910 | 1810 | 1720 | 1700 | 1680 | 1670 |
| 47 | B | 2100 | 2020 | 1820 | 1740 | 1680 | 1620 | 1580 | 1600 |
| 48 | B → k | 2280 | 2090 | 1910 | 1760 | 1680 | 1610 | 1590 | 1620 |
| 49 | A → o | 2320 | 2100 | 1870 | 1740 | 1670 | 1670 | 1660 | 1670 |
| 50 | B → o | 2270 | 2060 | 1830 | 1710 | 1670 | 1680 | 1650 | 1660 |
| 51 | D → m | 2250 | 2050 | 1850 | 1710 | 1650 | 1660 | 1650 | 1650 |
| 52 | E → m | 2210 | 2080 | 1860 | 1680 | 1650 | 1650 | 1650 | 1650 |
| 53 | D → m + g + h | 2460 | 2140 | 2010 | 1920 | 1780 | 1690 | 1670 | 1650 |
| 54 | A → o + g + h | 2480 | 2200 | 2060 | 1980 | 1820 | 1760 | 1690 | 1680 |

Square tips each having an inscribed circle having a diameter of 12.7 mm, and a thickness of 4.76 mm were cut out of the fired bodies, and measured for hardnesses. The hardnesses were measured as micro-Vickers hardnesses under a load of 1 kgf at positions spaced 0.1 mm, 0.2 mm, 0.3 mm, 0.5 mm, 0.7 mm, 1.0 mm, 3.0 mm, and 6.0 mm from the end faces of the tips. A product having the same composition and fired at the same temperature as the above fired bodies was produced as a comparative example (see Experimental Example 31 in Table 7).

According to Example 3, the hardnesses of Experimental Examples 32 ~54 varied in a gradient fashion, and were much higher than the hardness of the comparative example (Experimental Example 31).

EXAMPLE 4

90.5 weight % of WC, 0.8 weight % of TaC, 6 weight % of Co, and 2.7 weight % of NbC, all in powders having an average diameter of 1.5 $\mu$m, which were the same as those used in Example 3, were sufficiently mixed with each other in a wet process. 82 weight % of WC, 1.0 weight % of TaC, 15 weight % of Co, and 2 weight % of NbC were sufficiently mixed with each other in a wet process. These mixtures were molded in the same manner as Example 3, degreased and preliminarily fired under the same conditions. Some of the preliminarily fired bodies were then immersed in an aqueous solution of 25% of nickel nitrate and an solution of aluminum isopropoxide and titanium isopropoxide mixed at a ratio of 30:70, and the others were immersed in an aqueous solution of 25% of nickel nitrate and solutions of zirconium imide and chromium amide each having a concentration of 70%.

The preliminarily fired bodies were then dried and fired under the same conditions as those in Example 3. The fired bodies were then machined into tips each having an inscribed circle having a diameter of 12.7 mm and a thickness of 4.76 mm. These tips, the tip (Experimental Example 36) according to Example 3, a commercially available product corresponding to the JIS-P-10 material, commercially available products of cermet, and commercially available products treated by PVD and CVD were examined for thicknesses of hard ceramic layers formed on their surfaces, gradient composition widths as determined by EPMA, and tip surface harnesses $H_{RA}$. The measured values are given in Table 8 below.

TABLE 8

| Exp.Ex. | Types of tested materials | Ceramic layer thickness (μm) | Diffused distance (μm) | Surface hardness ($H_{RA}$) |
|---|---|---|---|---|
| 61 | * Product corresponding to JIS-P-10 (untreated) | — | — | 91.8 |
| 62 | * Cermet (untreated) | — | — | 91.8 |
| 63 | * JIS-P-10 treated by PVD (TiN, TiCN, alumina 5 layers) | 6 | 1 | 89.1 |
| 64 | * JIS-P-10 treated by CVD (TiN, TiCN, alumina 12 layers) | 6 | 2 | 89.2 |
| 65 | Co 6% treated by nickel nitrate, aluminum + titanium isopropoxides | 14 | 3000 | 98.1 |
| 66 | Co 15% treated by nickel nitrate, aluminum + titanium isopropoxide | 10 | 4200 | 97.8 |
| 67 | Co 6% treated by nickel nitrate, zirconium imide, and chrominum amide | 12 | 2400 | 96.8 |
| 68 | Co 15% treated by nickel nitrate, zirconium imide, and chrominum amide | 10 | 2100 | 96.8 |
| 69 | A → g + h (Exp. Ex. 36) | 12 | 1800 | 98.2 |

* Commercially available.

Figure 8:
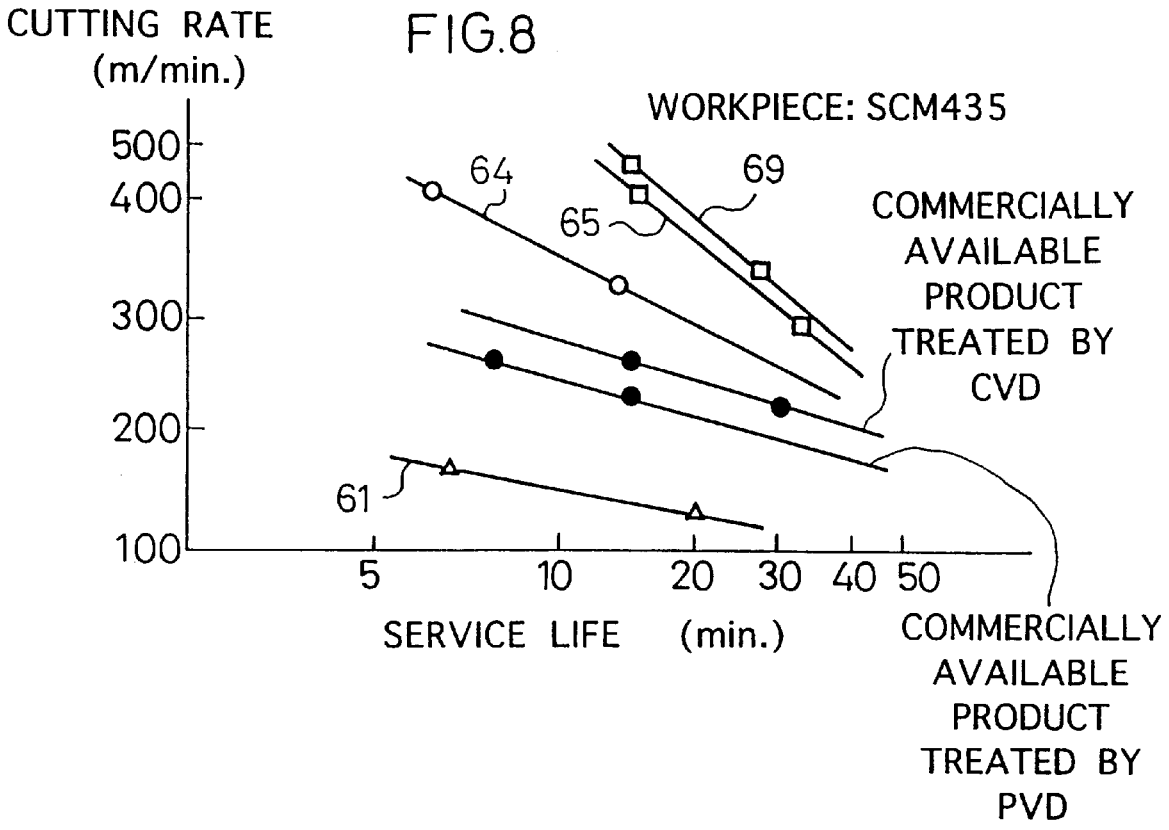
FIG. 8 is a diagram showing service life curves of tips before cutting workpieces of steel.
Figure 9:
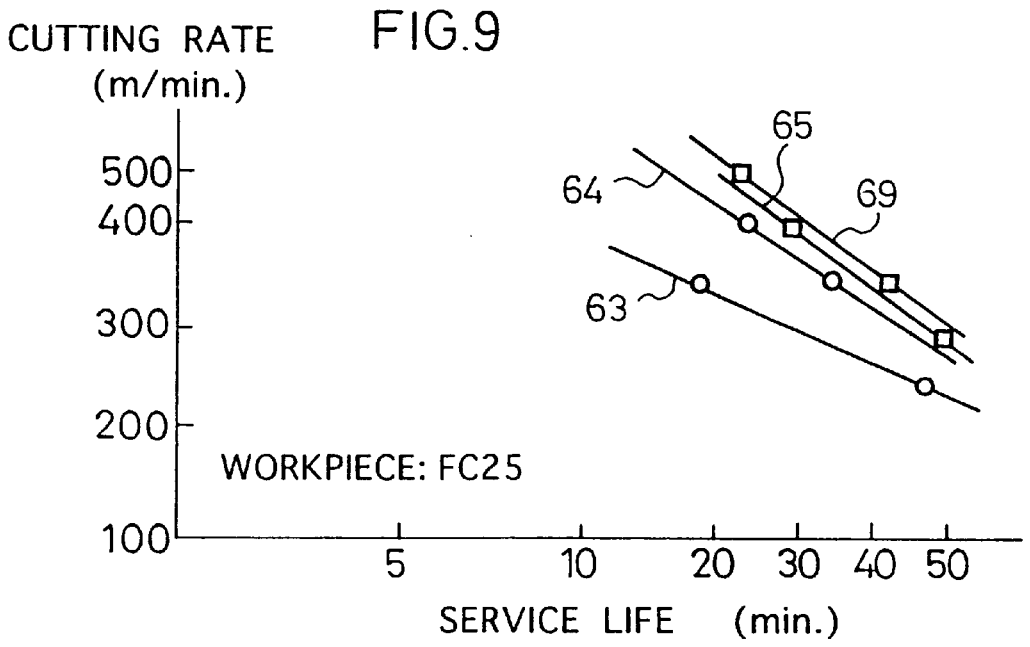
FIG. 9 is a diagram showing service life curves of tips before cutting workpieces of cast iron.
Figure 10:
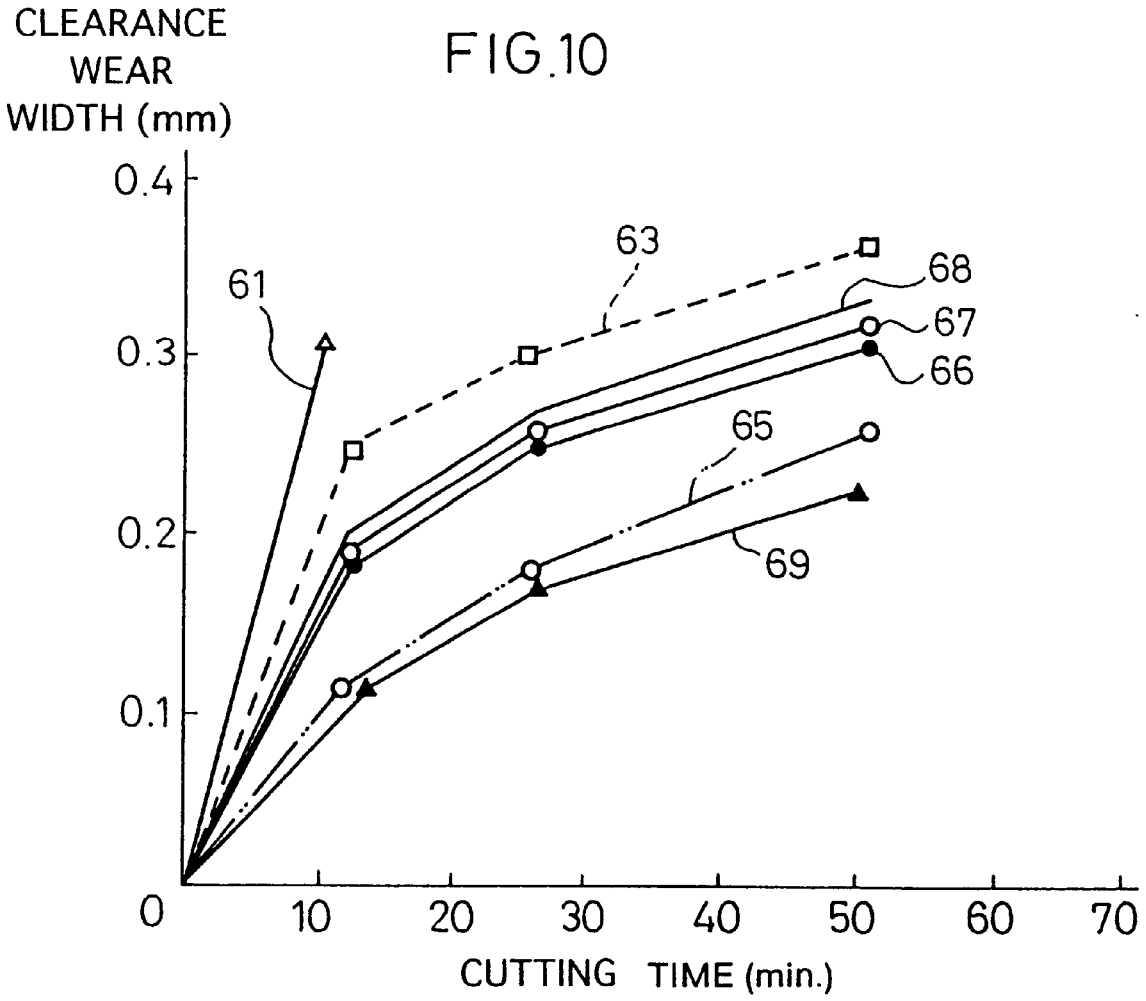
FIG. 10 is a diagram showing wear resistance curves of tips.

FIGS. 8 through 9 show the results of a life test conducted as an actual performance test, and FIG. 10 shows the results of a wear-resistance test. It can be seen from FIGS. 8 through 10, that Examples 3 and 4 had values much better than those of the commercially available product corresponding to the JIS-P-10 material, and exhibited better performance than the commercially available products treated by PVD and CVD.

It was recognized that all the properties of Examples 3 and 4 improved. This is because the hard ceramic layer produced on the surface was tough, indicating a hardness estimated to be close to the hardness of actual ceramic materials. While the hardness would be small if the produced ceramic layer were porous, the produced ceramic layer is assumed to be dense from the obtained values.

Since Examples 3 and 4 had a component diffused layer which is largely involved in the adhesion and durability of the surface layer, they actually had a gradient function for reliably preventing the surface layer from peeling off. Furthermore, no special equipment was needed to produce Examples 3 and 4, and any process of cleaning the interior of the chamber each time layer structures are changed for the production of Examples 3 and 4, unlike the production of multilayer coatings. Consequently, it is possible to produce cutter tips of carbide and cermet which are inexpensive and high in performance.

EXAMPLE 5

56 weight % of a powder of WC having an average diameter of 2 μm, 30 weight % of a powder of TiC having an average diameter of 1.5 μm, 5 weight % of a powder of TiN having an average diameter of 1.2 μm, 3 weight % of a powder of TaC having an average diameter of 1.5 μm, and 6 weight % of a powder of Co having an average diameter of 0.8 μm were sufficiently mixed by a wet mixing process. The mixture was then molded under pressure by a wet molding process, producing molded bodies each having a diameter of 12.5 mm and a length of 100 mm.

In order to remove a solvent of alcohol used and 0.1% of ammonium stearate added as a friction reducer in the molding process, the molded bodies were maintained at 250° C., 350° C., 450° C., and 650° C. for 10 minutes, 10 minutes, 15 minutes, and 30 minutes, respectively, under a reduced pressure ranging from 3 to 5 Torr in a nitrogen gas while nitrogen is flowing, and then maintained at 1000° C. for 30 minutes. The molded bodies thus heated were thus fired into preliminarily fired bodies.

Thereafter, the preliminarily fired bodies were machined into drill bit and reamer shapes, which were then immersed in an aqueous solution of 25% of nickel nitrate for 30 minutes, and then a mixed solution of aluminum isopropoxide and titanium isopropoxide. After they were dried, they were fired in a main firing process in which the temperature increased at a rate of 10° C./minute. Specifically, the preliminary sintered bodies were maintained at 650° C. for 45 minutes, then maintained at 1250° C. for 15 minutes, 1320° C. for 30 minutes, 1360° C. for 30 minutes, and 1380° C. for 60 minutes. The preliminary sintered bodies were fired in vacuum up to 1320° C., and under a pressure of 1 bar in a nitrogen gas beyond 1320° C.

The finally fired bodies had a gold-colored appearance, which confirmed the generation of TiC+TiN. The finally fired bodies were machined into the shapes of a drill bit and a reamer, which were provided with tips. Each of the finally fired bodies (the drill bit and the reamer) had a coated layer on its surface which had a thickness ranging from 20 to 30 μm.

Figure 11:
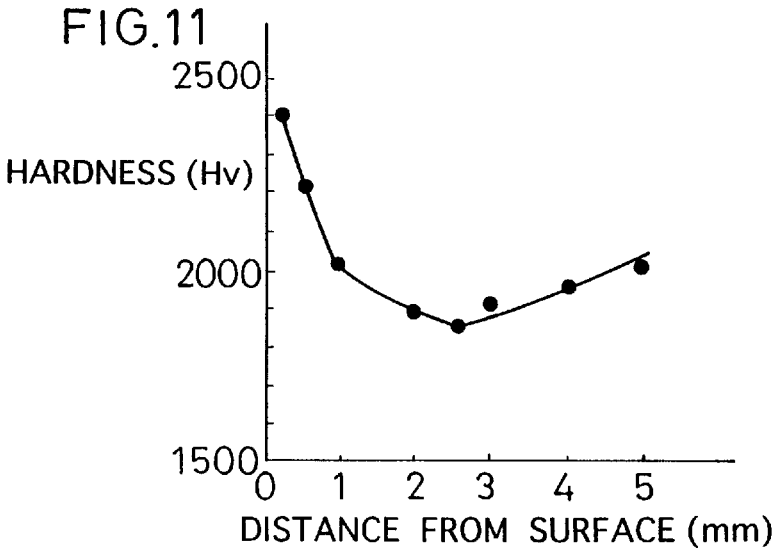
FIG. 11 is a diagram showing the relationship between the distance from the surface and the hardness of a composite material.
Figure 12:
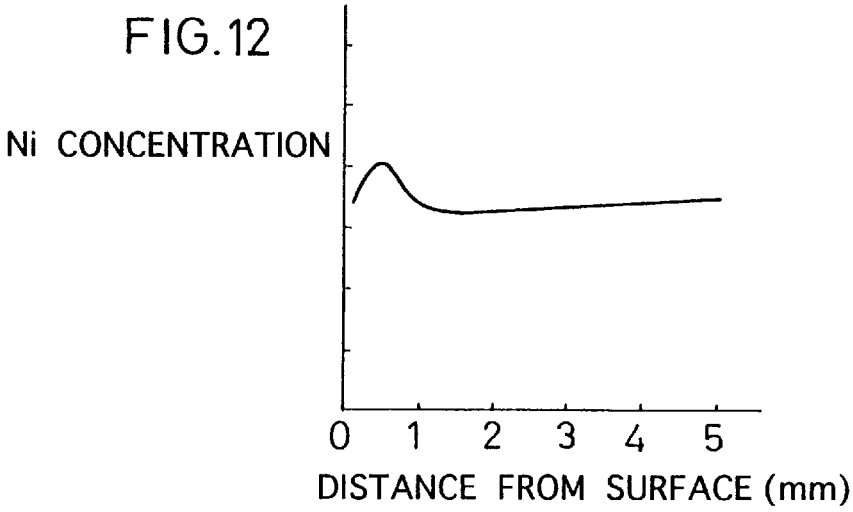
FIG. 12 is a diagram showing the relationship between the distance from the surface and the Ni concentration of the composite material.
Figure 13:
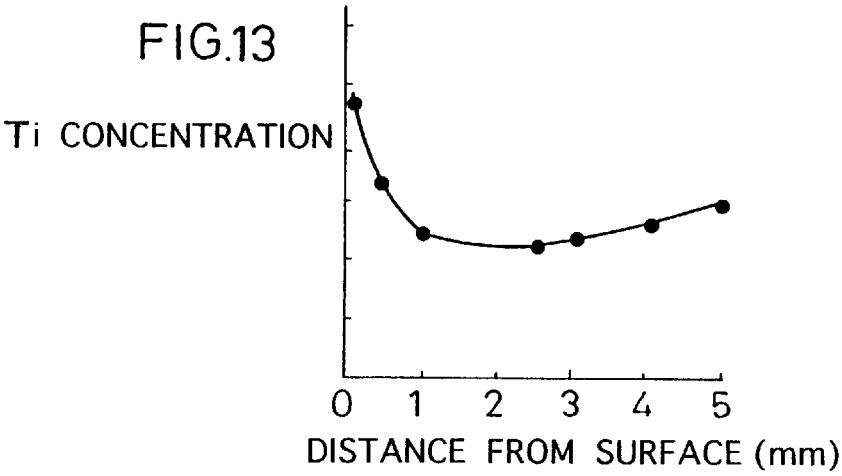
FIG. 13 is a diagram showing the relationship between the distance from the surface and the Ti concentration of the composite material.

The finally fired bodies were cut in a cross-sectional direction and measured for their properties. As shown in FIG. 11, the hardness of each of the finally fired bodies varied depending on the distance from the surface. The finally fired bodies contained Ni and Ti having concentrations shown in FIGS. 12 and 13. Since the drill bit and the reamer were treated in the same manner, the above properties were measured with respect to the drill bit only. It was found out that the finally fired bodies had gradient characteristics in a direction inward from their surface.

Figure 14:
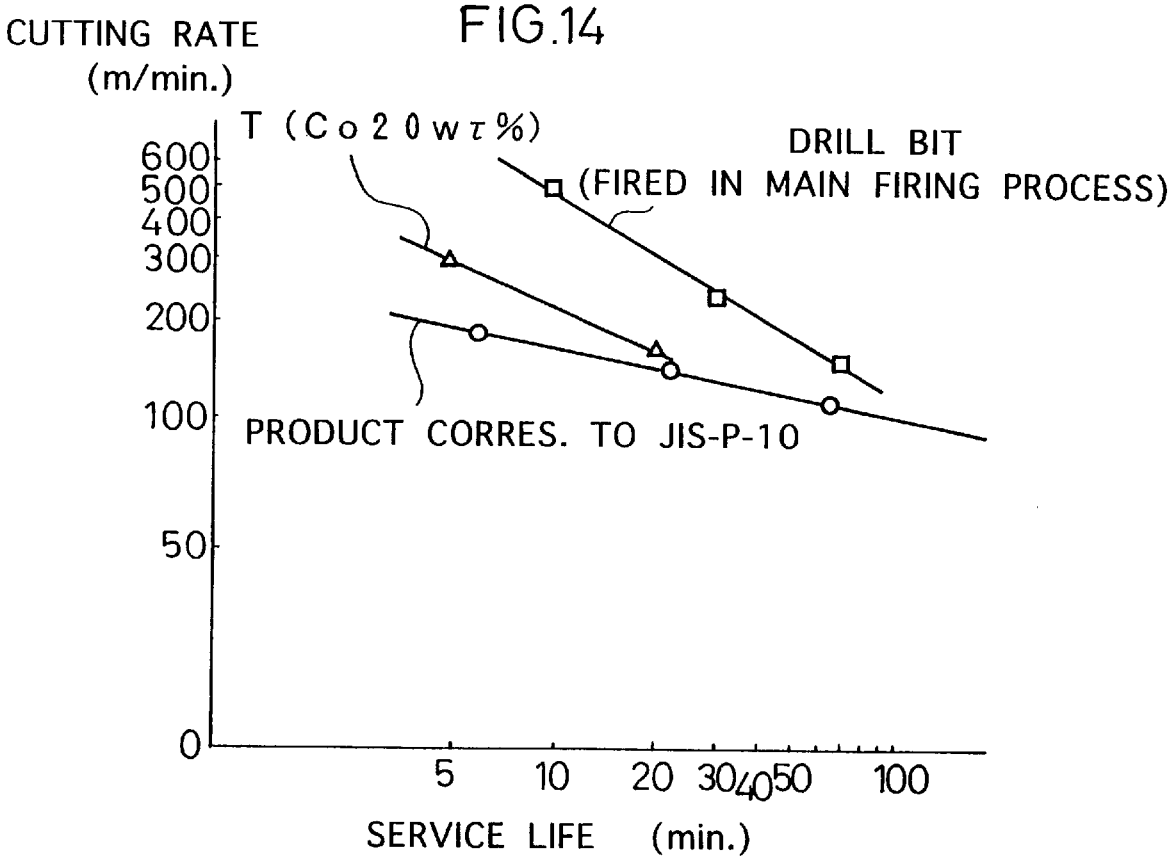
FIG. 14 is a diagram showing the results of life tests on drill bits.

The finally fired bodies were measured for service life, and the results are shown in FIG. 14. It can be seen from FIG. 14 that the service life of the finally fired bodies was much higher than that of the commercially available product corresponding to the JIS-P-10 material. In Example 5, the amount of Co in the commercially available product corresponding to the JIS-P-10 material was shown by way of example. However, since the amount of Co in a product corresponding to the JIS-P-30 material which is of high toughness and the greater amount of Co achieve a surface hardness Hv of 2000 or greater, it is possible to manufacture drill bits and reamers which are less liable to be broken and have a high cutting capability, from those materials as treated according to the present invention.. FIG. 14 shows a characteristic curve T representing a material containing 20 weight % of Co and treated according to the present invention.

Figure 15:
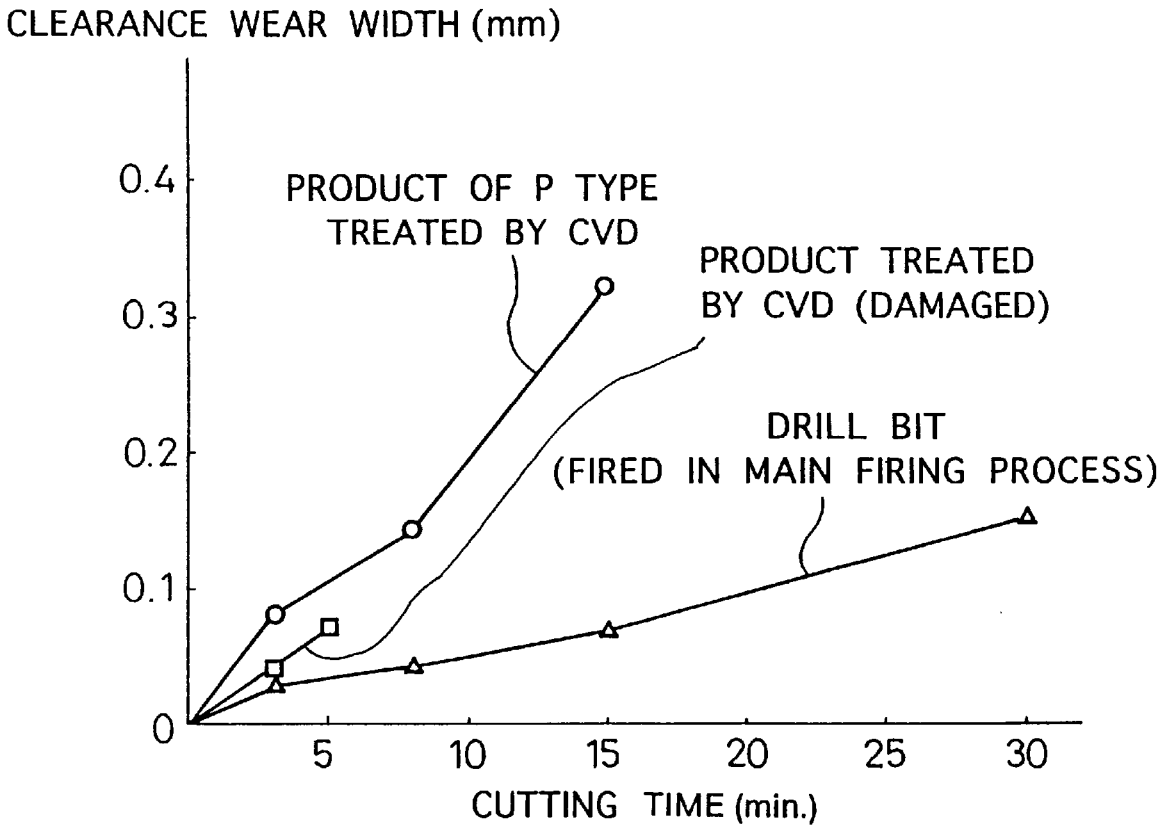
FIG. 15 is a diagram showing the wear resistance of drill bits.

The fired bodies according to the present invention, and a conventional product of the P type treated by PVD were tested for wear resistance. The results of the wear-resistance test are shown in FIG. 15. It will be understood from FIG. 15 that the fired bodies according to the present invention had much better wear resistance than the conventional products processed by PVD, CVD.

The method of manufacturing a composite material according to the present invention offers the following advantages:

According to the method, a grain growth accelerator in a form dispersed in an aqueous solution or an organic solvent is introduced into a preliminarily fired body, and thereafter the preliminarily fired body is fired in a main firing process. In the main firing process, a volumetric diffusion of metal and grain growth of ceramic particles are caused as the firing temperature increases. Therefore, it is possible to manufacture a composite material having such a gradient function that it is ceramic-rich on its surface and metal-rich in its inside. The wear resistance, sliding capability, and heat resistance of the surface layer of the composite material can be increased, and the strength of the internal structure of the composite material can be increased in a simple and inexpensive process.

Although certain preferred embodiments of the present invention have been shown and described in detail, it should be understood that various changes and modifications may be made therein without departing from the scope of the appended claims.

What is claimed is:

1. A method of manufacturing a metal-ceramic composite material, comprising the steps of:

producing a molded body of a mixture of a powder of a ceramic and a powder of metal particles, wherein at least some of said metal particles are disposed adjacently to each other in said molded body so as to be in contact along contacting regions thereof;

preliminary firing the molded body into a preliminarily fired body, the preliminary firing being conducted at a temperature and for a period of time sufficient to enable said contacting regions of said metal particles in said body to become fused together by volumetric diffusion while maintaining contiguous pores in said molded body;

impregnating said preliminarily fired body with a solution of a metal salt containing a ceramic grain growth accelerator which comprises at least one of iron, manganese, chromium, and an organic metal salt, or an alloy thereof; and finally firing said preliminarily fired body to promote grain growth of the ceramic near the surface of said body to thereby produce a metal-ceramic composite body having a gradient in which the percentage of metal component of said composite body increases inwardly from a surface thereof.

2. The method according to claim 1, wherein said metal salt comprises a nitrate, an acetate, or a chloride.

3. The method according to claim 1, wherein said organic metal salt comprises at least one of iron, nickel, and cobalt, manganese, and chromium, or an alloy thereof.

4. The method according to claim 1, wherein during said step of producing the molded body, a load is applied to said mixture to produce said molded body, said load being lower than a range for elastically deforming said metal.

5. A method of manufacturing a metal-ceramic composite material, comprising the steps of:

producing a molded body of a mixture of a powder of a ceramic and a powder of metal particles, wherein at least some of said metal particles are disposed adjacently to each other in said molded body so as to be in contact along contacting regions thereof;

preliminarily firing the molded body into a preliminarily fired body, the preliminary firing body being conducted at a temperature and for a period of time sufficient to enable contacting regions of said metal particles in said body to become fused together by volumetric diffusion while maintaining contiguous pores in said molded body;

impregnating said preliminarily fired body with a solution of a metal salt containing a ceramic grain growth accelerator which comprises at least one of chromium, manganese, iron, nickel, and cobalt, or a mixture thereof;

finally firing said preliminarily fired body to promote grain growth of the ceramic near the surface of said body to thereby produce a metal-ceramic composite body having a gradient in which the percentage of metal component of said composite body increases inwardly from a surface thereof; and forming a tip on said metal-ceramic composite body, thereby producing a composite body having a tip of cermet or carbide.

6. The method according to claim 5, wherein said metal salt comprises a nitrate, an acetate, or a chloride.

7. The method according to claim 5, wherein said organic metal salt comprises at least one of iron, nickel, and cobalt, manganese, and chromium and tungsten or a mixture thereof.

8. A method according to claim 5, wherein during said step of producing the molded body, a load is applied to said mixture to produce said molded body, said load being lower than a range for elastically deforming said metal.

* * * * *